United States Patent [19]

Kaga

[11] Patent Number: 5,035,973

[45] Date of Patent: Jul. 30, 1991

[54] IMAGE FORMING METHOD AND APPARATUS THEREFOR

[75] Inventor: Eiichi Kaga, Yokohama, Japan

[73] Assignee: Kabushiki Kaisha Toshiba, Kawasaki, Japan

[21] Appl. No.: 265,530

[22] Filed: Nov. 1, 1988

[30] Foreign Application Priority Data

Nov. 6, 1987 [JP] Japan ..... 62-279066

[51] Int. Cl.[5] ..... G03G 21/00; G03G 5/00; G03G 9/00; G03G 13/14

[52] U.S. Cl. ..... 430/125; 430/126; 430/130; 430/109; 430/110

[58] Field of Search ..... 430/109, 110, 125, 130, 430/127, 56, 126, 50

[56] References Cited

U.S. PATENT DOCUMENTS 3,501,294 3/1970 Joseph ..... 96/1.4
4,053,572 10/1977 Moss et al. ..... 423/490
4,568,176 2/1986 Murasawa ..... 430/125 X

FOREIGN PATENT DOCUMENTS 2056546 11/1970 Fed. Rep. of Germany ..... 430/117
58-134651 8/1983 Japan .
58-203481 11/1983 Japan .
60-173570 9/1985 Japan .
61-231558 10/1986 Japan .
61-231564 10/1986 Japan .

OTHER PUBLICATIONS

Armin K. Weiss & Edward Carnall Jr., "Method for Hot-Pressing Photoconductors", Research Disclosure, Aug. 1974, #12427.

*Primary Examiner*—Marion E. McCamish
*Assistant Examiner*—S. C. Crossan
*Attorney, Agent, or Firm*—Foley & Lardner

[57] ABSTRACT

An image forming method includes the steps of forming an electrostatic latent image on an image-carrying body, developing the electrostatic latent image using a developing agent, and transferring the developed image. A compound which reacts with nitrate ions causing an image flow and forms a water-insoluble substance is added on the surface of the image-carrying body, and then a cleaning is performed on the surface of the image-carrying body. The water-insoluble substance is removed from the surface of the image-carrying body, and therefore the image flow is prevented.

16 Claims, 1 Drawing Sheet

IMAGE FORMING METHOD AND APPARATUS THEREFOR

BACKGROUND OF THE INVENTION

1. Field of the Invention

The present invention relates to a method of forming an image on an image-carrying body in an image forming apparatus such as a copying machine, a laser printer and an LED printer, and an apparatus therefor.

2. Description of the Related Art

Generally, in an image forming apparatus such as a copying machine, a laser printer, and an LED printer for performing charging, exposure, developing, transferring, discharging, and the like on an image-carrying body and forming an image on transfer paper or the like, the surface resistance of the image-carrying body is reduced, especially in a high humidity atmosphere, and therefore the charging amount is reduced upon use for a long time period. When the charging amount is reduced, the image is blurred or obscured to cause an image flow, and finally image formation itself becomes impossible. This phenomenon occurs because a corona discharger is used in steps of charging, transferring, peeling, discharging, and the like. The corona discharger can uniformly perform charging of the image-carrying body and rarely causes insulation destruction of the image-carrying body. While the corona discharger has such advantages, it generates toxic substances such as ozone, metal oxides, and an oxygen compound during high energy discharging and oxidizes nitrogen in air to finally form nitrate ions. The nitrate ions are adhered on the surface of the image-carrying body to cause ionic conduction in the presence of water, thereby reducing the surface resistance of the image-carrying body.

The image flow phenomenon rarely occurs in a conventional image-carrying body using an inorganic photoconductive material such as selenium, selenium-tellurium, and cadmium-sulfide or a single layer type or function separating type organic photoconductive material.

An image-carrying body which is currently developed uses amorphous silicon (to be referred to as a-Si hereinafter) or microcrystalline silicon (to be referred to as μc-Si hereinafter) which has higher surface hardness and superior abrasion resistance and heat resistance than those of the above photoconductive material, need not be recovered because it has no toxicity, and has high sensitivity throughout a wide region from a visible range to an infrared range. However, in such an image-carrying body, the image flow occurs more easily than in the conventional image-carrying body. For this reason, this image-carrying body cannot be used for a long time period.

This is partially because a-Si or μc-Si is formed by plasma CVD and therefore has fine projections and depressions on its surface. That is, the surface unevenness increases the number of adsorption sites or adhesion site of the corona discharge product and makes it difficult to remove the corona discharge product by a mechanical removing means such as a cleaning blade. Another reason for this is that a-Si or μc-Si has a surface hardness much higher than that of the conventional photoconductive material. Therefore, unlike in the conventional photoconductive material, the corona discharge product is not removed from the surface by being scraped by a cleaning blade.

In order to eliminate the above drawbacks of the image-carrying body using a-Si or μc-Si, the surface of the image-carrying body is heated so that the image-carrying body does not absorb water, the surface of the image-carrying body is made hydrophobic, the cleaning method is improved, or the image-carrying body is contacted with ion-exchange material. However, a sufficient effect has not been obtained yet.

SUMMARY OF THE INVENTION

It is, therefore, an object of the present invention to provide an image forming method which can prevent reduction in surface resistance of an image-carrying body, thereby preventing image flow and forming a good image, and an apparatus therefor.

According to the present invention, there is provided an image forming method comprising the steps of: forming an electrostatic latent image on an image-carrying body; developing the electrostatic latent image; and transferring a developed image, wherein a compound which reacts with nitrate ions and forms a water-insoluble substance or a substance having a low dissociation coefficient is added to the surface of the image-carrying body, and then a cleaning treatment is performed on the surface of the image-carrying body.

In addition, according to the present invention, there is provided an image forming apparatus comprising: an image forming means for forming an electrostatic latent image on the image-carrying body; a developing means for developing the electrostatic latent image; a transferring means for transferring the developed image onto an image-carrying medium; an adding means for adding a compound which reacts with nitrate ions and forms a water-insoluble substance on the surface of the image-carrying body; and a cleaning means for performing a cleaning treatment on the surface of the image-carrying body.

In the method of the present invention, examples of the compound which reacts with nitrate ions and forms a water-insoluble substance or a substance having a low dissociation coefficient to be added on the surface of the image-carrying body are barium compounds such as barium carbonate ($BaCO_3$) and barium acetate ($Ba(CH_3COO)_2$), thallium compounds such as thallium carbonate ($Tl_2CO_3$) and thallium acetate ($TlCH_3COO$), bismuth compounds, organic compounds such as nitron ($C_{20}H_{16}N_4$), and the mixture thereof. Of the above compounds, a bismuth compound is most preferable because it has no toxicity.

Examples of the bismuth compound suitably used in the present invention are bismuth carbonate ($Bi_2(CO_3)_3$), bismuth acetate ($Bi(CH_3COO)_3$), bismuth phosphate ($BiPO_4$), bismuth oxide ($Bi_2O_3$), bismuth oxide ($Bi_2O_5$), bismuth hydroxide ($Bi(OH)_3$), bismuth chloride ($BiCl_3$), bismuth fluoride ($BiF_3$), bismuth bromide ($BiBr_3$), bismuth sulfate ($Bi_2(SO_4)_3$), bismuth nitrate ($Bi(NO_3)_3.5H_2O$), bismuth iodate ($Bi(IO_3)_3$), bismuth citrate ($BiC_6H_5O_7$), bismuth butyrate ($Bi(C_6H_9O_6).7H_2O$), bismuth gallate ($Bi(C_7H_5O_5)_3$), basic bismuth carbonate ($(BiO)_2CO_3$), basic bismuth acetate ($BiO.CH_3COO$), basic bismuth phosphate ($BiO.PO_4$), basic bismuth chloride ($BiOCl$), basic bismuth fluoride ($BiOF$), basic bismuth bromide ($BiOBr$), basic bismuth nitrate ($BiONO_3.H_2O$), and the mixture thereof. Of the above bismuth compounds, bismuth carbonate, bismuth oxide ($Bi_2O_3$), and basic bismuth acetate are most preferable.

Each of the above compounds to be added on the surface of the image-carrying body reacts with nitrate ions ($NO_3^-$) formed during corona discharge to form a nitrate and then forms a water-insoluble salt in the presence of water. In this case, water adsorbed on the surface of the image-carrying body is sufficient to form the water-insoluble salt.

DETAILED DESCRIPTION OF THE PREFERRED EMBODIMENTS

According to the present invention, nitrate ions which are formed during corona discharge and adhered on the surface of an image-carrying body and which cause an image flow are fixed on the surface of the image-carrying body by a chemical treatment and then removed by normal cleaning. In the chemical treatment performed on the surface of the image-carrying body, a compound which reacts with nitrate ions and forms a water-insoluble substance is used.

Various methods can be used to add the compound on the surface of the image-carrying body. For example, the compound may be mixed in a developing agent or may be applied on the surface of the image-carrying body by a fur brush, a rubber roller, a metal roller, or the like.

When the compound is applied on the surface of the image-carrying body by, e.g., a fur brush, a rubber roller, or a metal roller, a timing of applying the compound is not limited to formation time of an image. That is, the compound may be applied at an arbitrary timing or frequency, e.g., during warming-up of an image forming apparatus, intermittently each time 1,000 to 10,000 images are formed, when a power switch of the image forming apparatus is turned off, or every one to three days.

When the compound is mixed in a developing agent, the mixing amount of the compound is preferably 0.0001 to 5 wt %, and more preferably, 0.005 to 2 wt %, of the toner amount in the developing agent.

Figure 1:
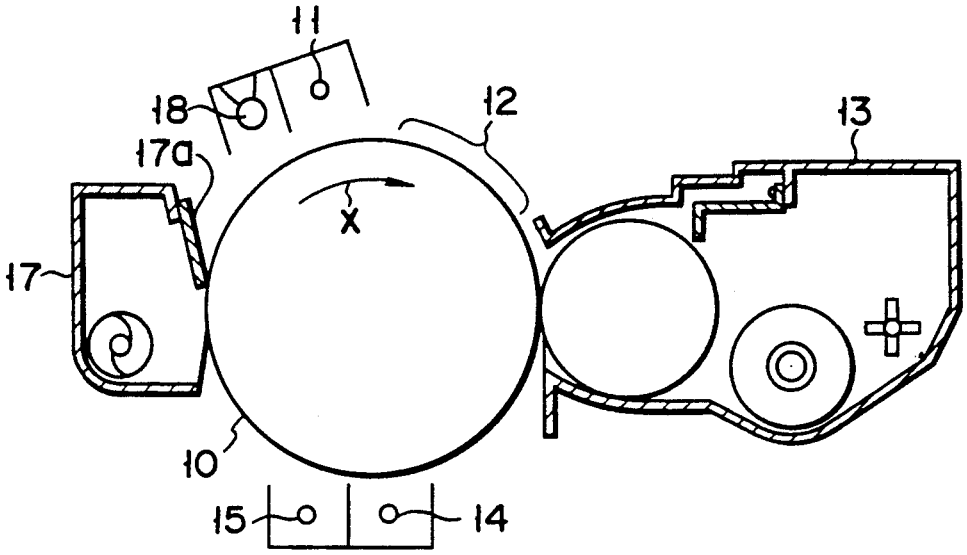
FIG. 1 is a schematic sectional view showing a copying machine used in one embodiment of the present invention.

FIG. 1 is a schematic sectional view showing a developing apparatus of a copying machine used in one embodiment of the present invention. In FIG. 1, photoreceptor drum 10 as an image-carrying body has a diameter of 78 mm and is obtained by depositing about 30-μm thick amorphous silicon (a-Si) on the surface of an aluminum tube. Charger 11, developing unit 13, transfer charger 14, separation charger 15, cleaner 17 having cleaning blade 17*a*, and discharge lamp 18 are disposed around drum 10. A two-component developing agent consisting of a toner and a carrier is contained in developing unit 13. 0.1 wt % of bismuth oxide ($Bi_2O_3$) with respect to a toner amount is mixed in the toner.

In an operation of the developing apparatus described above, drum 10 which rotates in an arrow direction is charged with surface potential of about 700 V by charger 11 which generates a charging corona current of 400 μA. An electrostatic latent image is formed on charged drum 10 at exposure section 12, and then development is performed using developing agent by developing unit 13. Note that nitrate ions may be adhered on the surface of drum 10 by corona discharge upon charging by charger 11. However, since bismuth oxide is contained in the developing agent, nitrate ions react with bismuth oxide in the toner adhered on the latent image, and form bismuth nitrate ($Bi(NO_3)_3.5H_2O$). Bismuth nitrate reacts with ambient moisture or water adsorbed on the surface and forms a water-insoluble salt.

A toner image formed by development is transferred to transfer paper (not shown) by the transfer charger. After the transfer paper is separated by the separation charger, cleaning is performed on the surface of drum 10 by cleaner 17. At this time, the water-insoluble salt is removed together with residual toner by cleaning blade 17*a*. The water-insoluble salt is formed not only when nitrate ions generated by corona discharge during charging by charger 11 and adhered on the surface of drum 10 react with bismuth ions in the toner but also when nitrate ions generated by corona discharge during transfer and separation and adhered on the surface of drum 10 react with bismuth ions in the toner.

Thereafter, drum 10 is discharged by lamp 18 to enable next image formation. Paper on which the toner image is transferred is subjected to fixing at a fixing section (not shown) to complete the image and then discharged.

EXAMPLE 1

Using a two-component developing agent consisting of a toner containing 0.1 wt % of bismuth oxide ($Bi_2O_3$) and a carrier, a copying running test was performed following the same procedures as described above under conditions of a temperature of 35° C. and a relative humidity of 75%. As a result, upon copying 300,000 copies, an image flow did not occur at all, image quality was not degraded, and an image was obtained with high resolution. A copying running test was performed following the same procedures as described above under the same conditions except that a developing agent not containing bismuth oxide was used. As a result, an image flow occurred upon copying 7,000 copies.

EXAMPLE 2

Using a two-component developing agent consisting of a toner containing 0.1 wt % of basic bismuth acetate ($BiO.CH_3COO$) and a carrier, a copying running test was performed following the same procedures as in Example 1. As a result, upon copying 300,000 copies, an image flow did not occur at all, image quality was not degraded, and an image was obtained with high resolution.

The present invention is not limited to the above embodiment and examples but can be variously modified. For example, the compound which reacts with nitrate ions and forms a water-insoluble substance is not limited to the bismuth compounds in the examples, but a variety of other compounds may be used. In addition, the developing agent is not limited to the two-component developing agent, but a one-component developing agent can be used. An amount of an additive compound can be selected arbitrarily. The compound need not be simply mixed in toner but can be mixed in a grinding step of a resin or dye which is a material of the toner.

Furthermore, the additive compound need not be contained in the developing agent but can be applied on the surface of the image-carrying body by other means.

Figure 2:
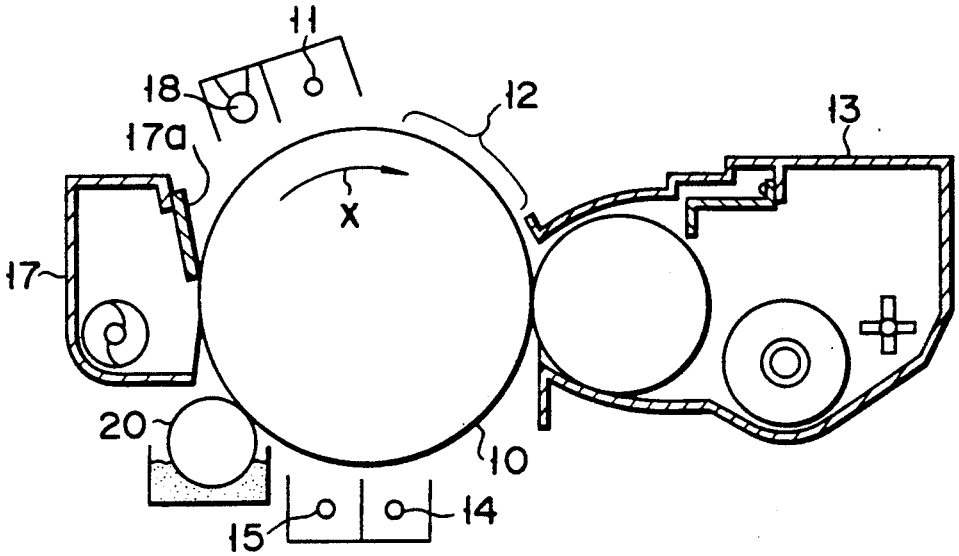
FIG. 2 is a schematic sectional view showing a copying machine used in another embodiment of the present invention.

For example, the compound may be applied by rubber or metal roller 20 as shown in FIG. 2.

In addition, the material of the image-carrying body is not limited to a-Si or $\mu$c-Si. For example, inorganic photoreceptors using inorganic photoconductive material such as Se and $As_2Se_3$, inorganic photoreceptors having a coating film formed on such inorganic photoconductive material, and various positive or negative charging organic photoreceptors may be employed. In particular a photoreceptor such as a negative charging organic photoreceptor which requires negative charging and easily causes an image flow may be used.

As has been described above, according to the method of the present invention, nitrate ions ($NO_3^-$) generated by corona discharge in image forming process and adhered on the surface of the image-carrying body can be fixed by a chemical treatment and then removed. For this reason, reduction in surface resistance of the image-carrying body caused by ionic conduction of nitrate ions ($NO_3^-$) can be prevented, a clear image can be formed without generating an image flow phenomenon, and a long service life of the image-carrying body can be achieved.

What is claimed is:

1. An image forming method comprising the steps of:

forming an electrostatic latent image on an image-carrying body in an image forming apparatus;

developing the electrostatic latent image using a developing agent; and transferring the developed image to an image-carrying medium, wherein nitrate ions are formed on the image-carrying body as a result of forming the image over repeated cycles, a compound which reacts with nitrate ions and forms a water-insoluble substance is deposited on the image-carrying body and subsequently reacts with said nitrate ions, and then a cleaning is performed continuously or at intervals on the surface of said image-carrying body, thus removing the water-insoluble substance.

2. A method according to claim 1, wherein the compound for forming the water-insoluble substance is at least one compound selected from the group consisting of a bismuth compound, a barium compound, and a thallium compound.

3. A method according to claim 2, wherein the compound for forming the water-insoluble substance is a bismuth compound.

4. A method according to claim 3, wherein the bismuth compound is at least one compound selected from the group consisting of bismuth carbonate, bismuth acetate, bismuth phosphate, bismuth oxide ($Bi_2O_3$), bismuth oxide ($Bi_3O_5$), bismuth hydroxide, bismuth chloride, bismuth fluoride, bismuth bromide, bismuth sulfate, bismuth nitrate, bismuth iodate, bismuth citrate, bismuth butyrate, bismuth gallate, basic bismuth carbonate, basic bismuth acetate, basic bismuth phosphate, basic bismuth chloride, basic bismuth fluoride, basic bismuth bromide, and basic bismuth nitrate.

5. A method according to claim 4, wherein the bismuth compound is at least one compound selected from the group consisting of bismuth carbonate, bismuth oxide ($Bi_2O_3$), and basic bismuth acetate.

6. A method according to claim 1, wherein the compound for forming the water-insoluble substance is contained in the developing agent and added to the surface of said image-carrying body during developing.

7. A method according to claim 6, wherein the amount of the compound for forming the water-insoluble substance is 0.0001 to 5 wt % of the toner amount in the developing agent.

8. A method according to claim 6, wherein the amount of the compound for forming the water-insoluble substance is 0.005 to 2 wt % of the toner amount in the developing agent.

9. A method according to claim 1, wherein the compound for forming the water-insoluble substance is directly applied on the surface of said image-carrying body by adding means.

10. A method according to claim 9, wherein said adding means is one member selected from the group consisting of a fur brush, a rubber roller, and a metal roller.

11. A method according to claim 10, wherein the compound for forming the water-insoluble substance is added each time an image is formed.

12. A method according to claim 10, wherein the compound for forming the water-insoluble substance is added during warming-up of an image forming apparatus.

13. A method according to claim 10, wherein the compound for forming the water-insoluble substance is intermittently added each time 1,000 to 10,000 images are formed.

14. A method according to claim 10, wherein the compound for forming the water-insoluble substance is added when a power switch of said image forming apparatus is turned off.

15. A method according to claim 10, wherein the compound for forming the water-insoluble substance is added every one to three days.

16. A method as claimed in claim 1, wherein said image-carrying body comprises an amorphous silicon as a photoconductive material.

* * * * *